US006909869B2

(12) United States Patent
Yamamoto et al.

(10) Patent No.: US 6,909,869 B2
(45) Date of Patent: Jun. 21, 2005

(54) DEVELOPER REGULATING MEMBER AND DEVELOPING APPARATUS

(75) Inventors: Shinya Yamamoto, Shizuoka (JP); Tetsuya Kobayashi, Shizuoka (JP); Yasunari Watanabe, Shizuoka (JP); Yasuomi Aso, Shizuoka (JP); Masato Koyanagi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 10/449,197

(22) Filed: Jun. 2, 2003

(65) Prior Publication Data

US 2003/0223783 A1 Dec. 4, 2003

(30) Foreign Application Priority Data

Jun. 3, 2002 (JP) ..... 2002-162056

(51) Int. Cl.[7] ..... G03G 15/08
(52) U.S. Cl. ..... 399/284
(58) Field of Search ..... 399/274, 284

(56) References Cited

U.S. PATENT DOCUMENTS

| | | | | |
|---|---|---|---|---|
| 4,774,543 A | | 9/1988 | Yoshikawa et al. | |
| 5,307,127 A | | 4/1994 | Kobayashi et al. | |
| 5,369,478 A | | 11/1994 | Kobayashi et al. | |
| 5,600,417 A | * | 2/1997 | Iguchi et al. | 399/279 |
| 5,678,130 A | | 10/1997 | Enomoto et al. | 399/55 |
| 5,689,783 A | | 11/1997 | Sasame et al. | 399/284 |
| 5,797,070 A | * | 8/1998 | Waki et al. | 399/149 |
| 5,873,010 A | | 2/1999 | Enomoto et al. | 399/39 |
| 5,893,013 A | | 4/1999 | Kinoshita et al. | 399/284 |
| 6,026,265 A | | 2/2000 | Kinoshita et al. | 399/281 |
| 6,376,087 B1 | * | 4/2002 | Ozeki et al. | 428/447 |
| 6,415,127 B1 | | 7/2002 | Yamamoto et al. | 399/284 |
| 6,421,512 B2 | | 7/2002 | Watanabe et al. | 399/149 |
| 2002/0057927 A1 | | 5/2002 | Kobayashi et al. | 399/159 |
| 2003/0077088 A1 | | 4/2003 | Adachi et al. | 399/129 |

FOREIGN PATENT DOCUMENTS

| | | |
|---|---|---|
| JP | 4-55872 | 2/1992 |
| JP | 6-186838 | 7/1994 |
| JP | 7-281527 | 10/1995 |
| JP | 8-69173 | 3/1996 |

* cited by examiner

*Primary Examiner*—William J. Royer
(74) *Attorney, Agent, or Firm*—Fitzpatrick, Cella, Harper & Scinto

(57) ABSTRACT

In a developing apparatus, the developing apparatus includes a developer carrying member which carries a developer and has elasticity, and a developer regulating member which regulates an amount of the developer carried on the developer carrying member, the developer regulating member having a supported part supported by a support member and a contact part which is in contact with the developer carrying member, in which the contact part has a ten point average surface roughness of larger than 2.0 $\mu$m and a maximum height surface roughness of smaller than an average particle diameter of the developer. Therefore, an amount of the developer carried on the developer carrying member can be regulated to be uniform.

41 Claims, 5 Drawing Sheets

DEVELOPER REGULATING MEMBER AND DEVELOPING APPARATUS

BACKGROUND OF THE INVENTION

1. Field of the Invention

The present invention relates to a developer regulating member for regulating an amount of developer carried on a developer carrying member, and a developing apparatus having this developer regulating member. Those are preferably used for a copier, a printer, an image forming apparatus such as a facsimile apparatus, or a process cartridge that can be detachably attached to an image forming apparatus main body.

2. Related Background Art

Conventionally, in an image forming apparatus such as a copier, a printer, or a facsimile apparatus provided with a function for forming an image on a recording medium, an electrostatic latent image formed on an electrostatic latent image bearing member is visualized as a developer image (toner image) using a developer by a developing apparatus.

As such a developing apparatus, for example, a dry one-component contact developing apparatus has been proposed and put to practical use. In this case, an electrostatic latent image is often developed by pushing a developer carrying member carrying a developer, which rotates in the same manner as a rotating electrostatic latent image bearing member, against or bringing it into contact with the electrostatic latent image bearing member with an appropriate relative peripheral velocity difference. In addition, in this case, there are many advantages in that, for example, a magnetic material is unnecessary so that simplification and miniaturization of the apparatus are easy, and the apparatus can be applied to a full-color image forming apparatus by using a nonmagnetic toner.

In a contact development system, a developing roller having elasticity and electric conductivity is often used as a developer carrying member. That is, since an electrostatic latent image is developed by pushing the developer carrying member against or bringing it into contact with an electrostatic latent image bearing member, in particular, in the case in which the electrostatic latent image bearing member is a rigid body, the developing roller is constituted by an elastic body in order to avoid damage to the electrostatic latent image bearing member.

In addition, it is also possible to provide a conductive layer on a surface of the developing roller or in the vicinity of the surface to apply a developing bias to the developing roller.

Moreover, in general, for the purpose of imparting an electric charge to a toner and forming a uniform thin toner layer, a developing blade is abutted against the developer carrying member as a developer regulating member. In this case, it is possible to use an elastic blade that is constituted by a thin metal plate having rubber or spring elasticity, as the developing blade.

The structure of a conventional developing apparatus will be described with reference to Fig. The developing apparatus 5 includes a developer container 56 for containing a developer 55. A developer carrying member 51 is provided in an opening part of the developer container 56, which is opposed to an electrostatic latent image bearing member 11 of the developing apparatus, with a developing part thereof exposed.

A developing roller 51 serving as the developer carrying member is an elastic roller having electric conductivity which has silicon rubber as a base layer and is coated with acrylic urethane rubber as a surface layer. The developing roller 51 is driven to rotate in a direction of arrow A'.

A developing blade 53 of a thin metal plate serving as a developer regulating member is provided in the developer container 56 containing the developer 55. The developing blade 53 is supported in a supported part thereof by a blade support metal sheet 52, and the vicinity of its tip on the free end side thereof is abutted against an external peripheral surface of the developing roller 51 so as to be in surface contact with the external peripheral surface.

Moreover, in the developer container 56, a developer supply roller (supply roller) 54 having elasticity abuts against the developing roller 51 and is driven to rotate in a direction of arrow B' which is counter to the rotating direction A' of the developing roller 51. The supply roller 54 is a sponge roller and is provided further on the upstream side of the rotating direction A' of the developing roller 51 than the developing blade 53 for the purpose of supplying the developer 55 to the developing roller 51 and removing the developer 55 which is not used for development and remains on the developing roller 51.

The developer 55 is a nonmagnetic one-component developer containing a nonmagnetic toner. The developer 55 is externally added with an appropriate amount of hydrophobic silica for the purpose of improving toner charging property and transfer efficiency thereof.

The developer 55 is drawn up to the developing roller 51 by the supply roller 54, and the developing roller 51 rotates to carry the developer 55 to a developing portion opposed to the electrostatic latent image bearing member 11. In the course of carrying the developer 55, the developing blade 53 removes excess developer 55 on the developing roller 51, whereby an amount of developer 55 on the developing roller 51, that is, the developer layer thickness, is regulated.

In the developing apparatus with the above-mentioned structure, a thin layer of the nonmagnetic developer 55 can be formed satisfactorily on the developing roller 51, and an electrostatic latent image on the electrostatic latent image bearing member 11 can be developed satisfactorily.

However, in the prior art as described above, the developing roller 51 serving as a developer carrying member is an elastic roller having elasticity. In the case in which the developing roller 51 is abutted against the developing blade 53 serving as a developer regulating member for a long period of time, deformation of the developing roller 51 occurs in the abutment portion between the developing roller 51 and the developing blade 53, so that a developer 55 is not coated uniformly on the developing roller 51. Therefore, there is a problem in that a sharp line of high density appears in the formed image, that is, so-called developing roller set image failure occurs at a rotation period of the developing roller 51.

SUMMARY OF THE INVENTION

It is an object of the present invention to provide a developer regulating member which can uniformly regulate an amount of a developer carried on a developer carrying member, and a developing apparatus having the same.

It is another object of the present invention to provide a developer regulating member which can uniformly regulate an amount of a developer on a developer carrying member even if the developer carrying member is deformed, and a developing apparatus having the same.

It is still another object of the present invention to provide a developer regulating member and a developing apparatus which can form a stable layer of a developer on a developer carrying member.

It is yet still another object of the present invention to provide a developer regulating member and a developing apparatus which do not cause development unevenness.

Other objects and features of the present invention will be more apparent from the following detailed description of the present invention taken in conjunction with the accompanying drawings.

DESCRIPTION OF THE PREFERRED EMBODIMENTS

A developer regulating member and a developing apparatus in accordance with the present invention will be hereinafter described in more detail with reference to the accompanying drawings. Note that the dimensions, materials, shapes, and relative arrangement of the components described in the following embodiments should be as changed as appropriate according to the structure of an apparatus to which the present invention is applied and various conditions, and are not meant to limit the scope of the present invention only to them.

First Embodiment

Figure 1:
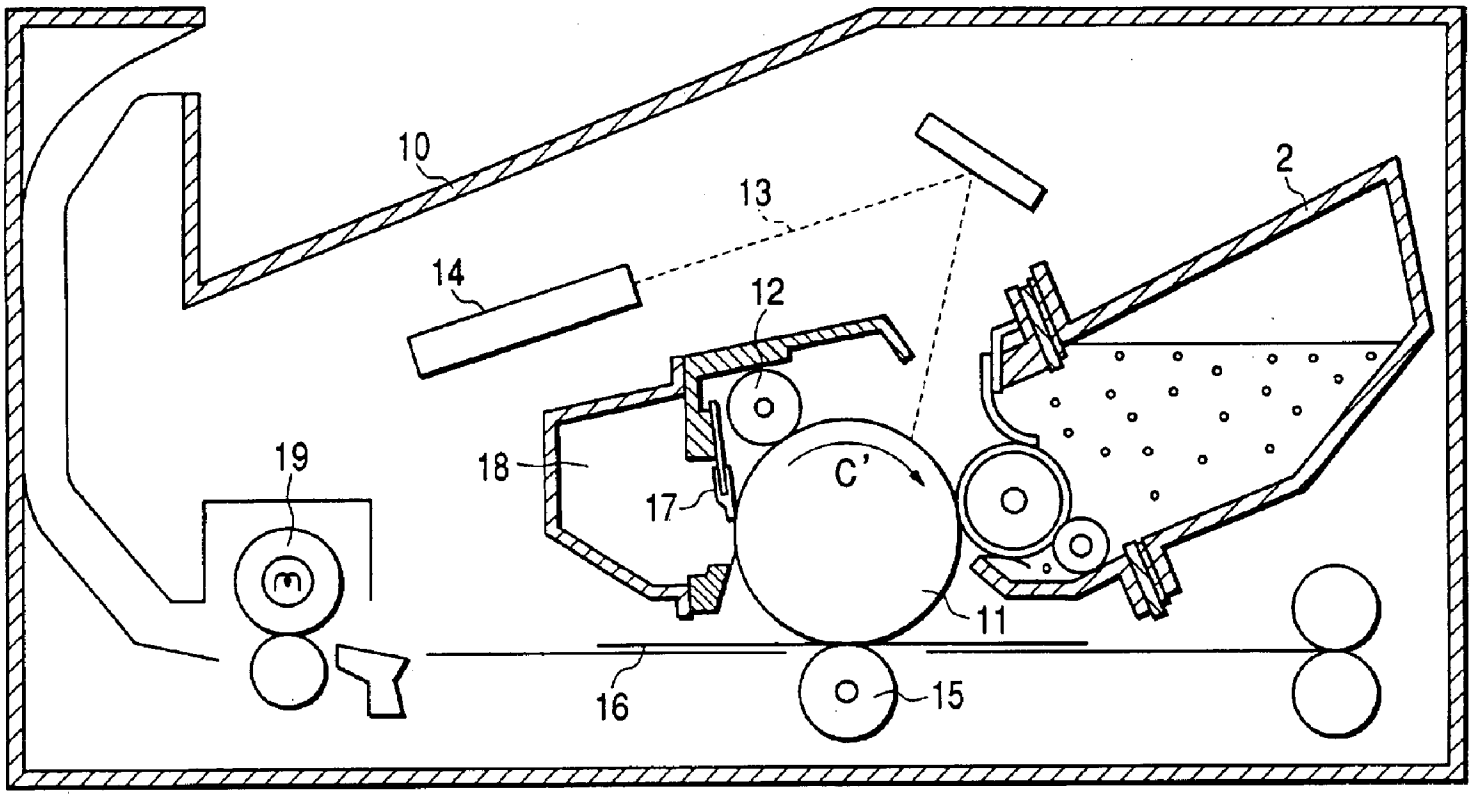
FIG. 1 is a schematic diagram showing an example of an image forming apparatus in accordance with the present invention.
Figure 2:
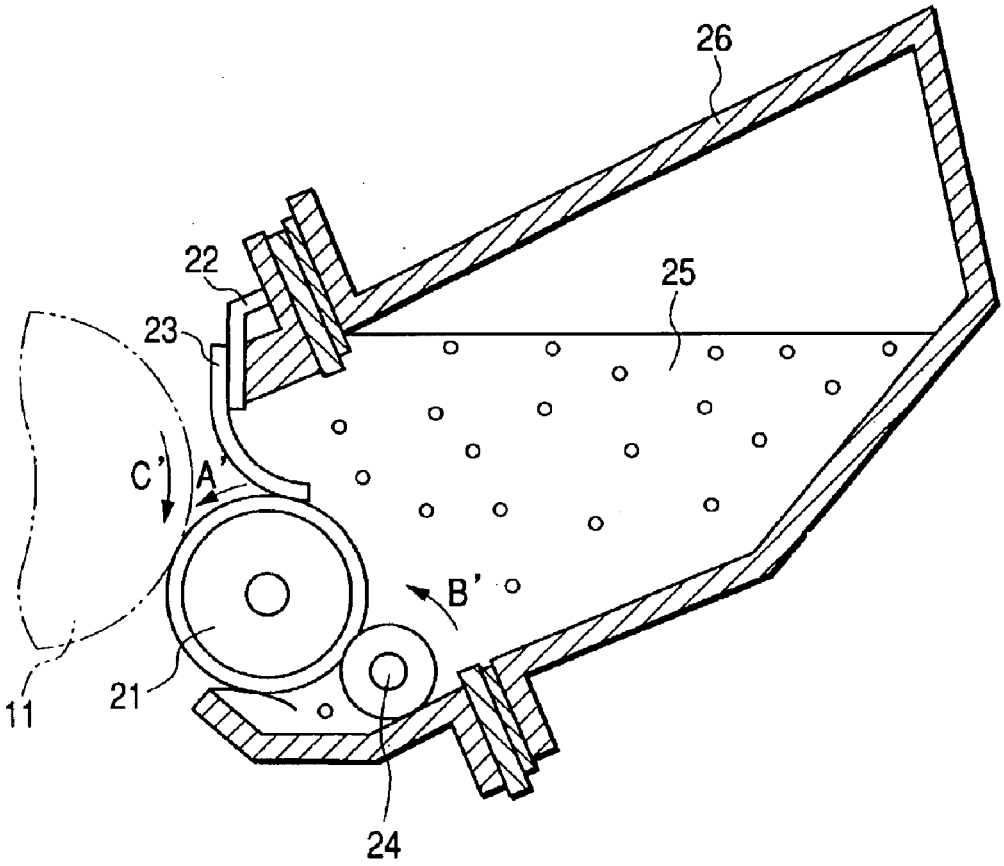
FIG. 2 is a sectional view showing an example of a developing apparatus in accordance with the present invention.

FIG. 1 is a schematic sectional view of an image forming apparatus 10 to which the present invention is applied. FIG. 2 is a schematic sectional view of a developing apparatus 2.

First, an image forming operation by the image forming apparatus 10 will be described.

In FIG. 1, a photosensitive drum 11 serving as an electrostatic latent image bearing member, on which an electrostatic latent image is formed, rotates in a direction of arrow C'. First, the photosensitive drum 11 is uniformly charged by a charging device 12. Thereafter, the photosensitive drum 11 is exposed to a laser beam 13 from a laser optical device 14 serving as exposure means, and an electrostatic latent image is formed on a surface thereof.

This electrostatic latent image is developed by the developing apparatus 2 arranged so as to be pushed against or in contact with the photosensitive drum 1 with a predetermined push-in amount, and visualized as a developer image (toner image).

The visualized toner image on the photosensitive drum 11 is transferred onto a recording medium 16 by a transfer roller 15 serving as transfer means. A transfer residual toner which is not transferred and remains on the photosensitive drum 11 is removed by a cleaning blade 17 serving as cleaning means (cleaner) to be contained in a waste toner container 18. The cleaned photosensitive drum 11 repeats the above-mentioned action to perform image formation.

On the other hand, the recording medium 16 having the toner image transferred thereon is permanently fixed with the toner image by a fixing device 19 and delivered to the outside of the image forming apparatus 10.

The developing apparatus 2, which is a characteristic part of the present invention, will be further described based upon FIG. 2.

A nonmagnetic one-component toner (hereinafter referred to as developer) that is negatively charged is used as a developer 25. The developer 25 is contained in a developer container 26. Further, the developing apparatus 2 is provided with a developing roller 21 serving as a developer carrying member so as to be arranged opposed to the photosensitive drum 11 in an opening part extending in a longitudinal direction of the developer container 26. The developing roller 21 carries the developer 25 to a developing portion opposed to the photosensitive drum 11 to develop and visualize an electrostatic latent image on the photosensitive drum 11.

The photosensitive drum 11 is a rigid body which has an aluminum cylinder as a base body and is coated with a photosensitive layer having a predetermined thickness around the aluminum cylinder. At the time of image formation, the photosensitive drum 11 is uniformly charged to a charging potential Vd=−700V by the charging device 12, and the potential of a part thereof exposed to the laser beam 13 in accordance with an image signal is changed to V1=−150V. A DC voltage Vdc=−400V is applied to a metal core of the developing roller 21 as a developing bias, and the negatively charged developer 25 moves to the V1 part, whereby the electrostatic latent image is reversely developed.

In this embodiment, in the opening part of the developer container 26, the developing roller 21 having elasticity is provided horizontally, with substantially the right half of its peripheral surface thereof being projected into the developer container 26 and substantially the left half of its peripheral surface being exposed from the developer container 26 in the sectional view shown in FIG. 2. The surface exposed from the developer container 26 is opposed to the photosensitive drum 11, which is located to the left of the developing apparatus 2 in the sectional view of FIG. 2, so as to be pushed against and in contact with the photosensitive drum 11 in a predetermined push-in amount. In this embodiment, the developing roller 21 is pushed into the photosensitive drum 11 by 50 $\mu$m and comes into contact with the same. The hardness of the developing roller 21 is preferably 35 to 70° in the ASKER-C hardness (applied pressure 9.8N). In this embodiment, the hardness is set to be 53°.

The developing roller 21 is driven to rotate in a direction of arrow A' which is along the rotation direction C' of the photosensitive drum 11. The developing roller 21 in this embodiment has a two-layer structure which has silicon rubber as a base layer and is coated with acrylic urethane rubber on its surface. As for the surface roughness of the developing roller 21, a center line average surface roughness Ra=1.2 $\mu$m, a ten point average surface roughness Rz=7.0 $\mu$m, and a maximum height Rmax=10.0 $\mu$m. In addition, the developing roller 21 has a resistance of $10^4$ to $10^6$ Ω.

Here, a method of measuring a resistance will be described. The developing roller 21 is abutted against an aluminum sleeve having a diameter equal to that of the photosensitive drum 11 with an abutment load of 500 gf (=4.9N). This aluminum sleeve is rotated at a peripheral velocity equal to that of the photosensitive drum 11. In this embodiment, the photosensitive drum 11 rotates at the peripheral velocity of 90 mm/sec and has a diameter of 30 mm, and the developing roller 21 rotates at the peripheral velocity of 120 mm/sec which is higher than that of the photosensitive drum 11 and has a diameter of 16 mm. Next, a DC voltage of −400 V, which is equal to the developing bias of this embodiment, is applied to the developing roller 21. In this case, a resistor of 10 KΩ is provided on the ground side, and a voltage at both ends thereof is measured to calculate a current to thereby calculate the resistance of the developing roller 21.

Inside the developer container 26, a developer supply roller (supply roller) 24 having elasticity is abutted against the developing roller 21 and rotatably supported in a position upstream of a developing blade 23 serving as a developer regulating member in the rotating direction A' of the developing roller 21, that is, below the developing roller 21 in this example. As the supply roller 24, one having a sponge structure or a fur brush structure in which fiber of rayon, nylon, or the like is planted on the metal core is preferred from the viewpoint of facilitating supply of the developer 25 to the developing roller 21 and removal of an unused developer 25. In this embodiment, the supply roller 24 is a urethane sponge roller and is driven to rotate in a rotating direction B' which is a direction counter to the rotating direction of the developing roller 21 and is the same as the rotating direction A' of the developing roller 21.

In this embodiment, as the negatively-charged nonmagnetic toner (developer) 25, which is a one-component developer contained as the developer 25, a substantially spherical toner is used in order to attain a small particle diameter and improve the transfer efficiency to realize high quality of an image. More specifically, a toner having SF-1 of 100 to 180 and SF-2 of 100 to 140 as shape factors is used.

Those SF-1 and SF-2 are defined as values found according to the following expressions by sampling 100 toner images at random using FEOSEM (S-800) (product name) manufactured by Hitachi, Ltd., and introducing information on these images into an image analysis apparatus Lusex3 (product name) manufactured by Nicolet via an interface and analyzing the information.

$$SF\text{-}1=\{(MXLNG)2/\mathrm{AREA}\}\times(\pi/4)\times 100$$

$$AF\text{-}2=\{(PERI)2/\mathrm{AREA}\}\times(\pi/4)\times 100$$

(Here, MXLNG is an absolute maximum length, AREA is a toner projection area, and PERI is a peripheral length.)

The shape factor SF-1 of this toner indicates a degree of sphericity. A toner particle gradually changes from spherical to amorphous as SF-1 increases from 100. SF-2 indicates a degree of unevenness. Unevenness on a toner surface becomes conspicuous as SF-2 increases from 100.

Any method of manufacturing a toner may be adopted as long as the shape factor of toner ranges within the above-mentioned shape factors. For example, it is possible to subject a conventional grinded toner surface to plastic spheroidizing treatment by thermal or mechanical stress. It is also possible to use a method of manufacturing a toner directly by a suspension polymerization method, a dispersion polymerization method of generating a toner directly using a water borne organic solvent, which is soluble for monomer and insoluble for obtained polymer, an emulsion polymerization method represented by a soap-free polymerization method of generating a toner by directly polymerizing under existence of an initiator which is water soluble and has a polarity, and the like.

In this embodiment, negatively charged toner with a weight average particle diameter of approximately 7 μm, in which toner particles having weight average particle diameter of 4 μm or less comprise 25 number of particles % or less, is manufactured by using the suspension polymerization method, with which the shape factors SF-1 and SF-2 can be relatively easily controlled to 100 to 180 and 100 to 140, respectively, and a particle diameter of 4 to 8 μm with a sharp granularity distribution can be obtained, under the normal pressure or under pressurization, and adding styrene and n-butyl acrylate as monomer, salicylate metal compound as a charging controller, and saturated polyester as polar resin, and further adding a colorant.

A Coulter counter TAII or a Coulter multirizer (manufactured by Coulter) is used for the measurement of the weight average particle diameter of a toner. As an electrolytic solution, 1% NaCl water solution is adjusted using a first grade sodium chloride. A surfactant of 0.1 to 5 ml, preferably alkyl benzenesulfonate is added as a dispersing agent in 100 to 150 ml of this electrolytic solution, and 2 to 20 mg of a measurement sample is further added. The electrolytic solution suspended with the sample is subjected to dispersion treatment for approximately 1 to 3 minutes by an ultrasonic distributor. The volume and the number of toner particles with a particle diameter of 2 μm or more are measured using an aperture of 100 μm by the measurement apparatus to calculate the volume distribution and the number distribution of the toner particles to find a weight average particle diameter D4 on the basis of weight from the volume distribution.

Thereafter, 1.5 wt % of hydrophobic silica is externally added as a fluidity imparting agent which is an external additive. Of course, an amount of external additive is not limited to this. By covering the toner surface with the external additive, improvement of negative chargeability and improvement of fluidity through provision of a fine gap between toner particles are attained.

In this embodiment, above the developing roller 21, the developing blade 23 serving as a developer regulating member having elasticity is supported by a support metal sheet 22 serving as a support member and is provided such that the vicinity of its tip on the free end side thereof is abutted against an external peripheral surface of the developing roller 21 so as to be in surface contact with the external peripheral surface. The developing blade 23 is provided with a supported part to be supported by the support metal sheet 22 and a contact part coming into contact with the developing roller 21. In this embodiment, as the material of the developing blade 23, a phosphor bronze thin metal plate is used. As for the surface roughness of the developing blade 23, a center line average surface roughness Ra=0.4 μm, a ten point average surface roughness Rz=3.0 μm, and a maximum height Rmax=5.0 μm. The direction of abutment is a counter direction in which the tip of the developing blade 23 on the free end side is located on the upstream side in the rotation direction A' of the developing roller 21 with respect to the abutment part. In addition, as shown in FIG. 2, the developing blade 23 is provided such that a free end thereof is in non-contact with the surface of the developing roller 21. However, edge abutment may be adopted in which the free end of the developing blade 23 is in contact with the developing roller 21. In order to make a toner coat amount on the developing roller 21 appropriate, the linear pressure of the developing blade 23 against the developing roller 21 is preferably 15 to 50 g/cm. In this embodiment, the linear pressure is set to be 30 g/cm.

As described above, in the case in which a printout test for 10,000 sheets was performed using the image forming apparatus 10 and the developing apparatus 2, a high quality image with a constant thin toner layer amount on the developing roller 21 and a stable image concentration could be obtained without occurrence of developing roller set image failure described with reference to the prior art example and without generation of a vertical streak image.

Here, effects of the present invention will be specifically described according to experimental examples.

EXPERIMENTAL EXAMPLE 1

The conventional developing apparatus (developing apparatus in which a surface of the developing blade 53 with respect to the developing roller 51 is a flat surface) was left as it was for one month in an environment of normal temperature and normal humidity (25° C., 60% RH), and a printout test of the developing apparatus 5 was performed. As a result, a sharp line of high density appeared in the formed image, that is, so-called developing roller set image failure occurred at a rotation period of the developing roller 51.

As a result of observing the developing roller set image failure, it was found that the developing roller set image failure occurred in a portion where the developing roller 51 and the developing blade 53 abutted with each other while the developing apparatus was left in the environment of normal temperature and normal humidity. In addition, since the developing roller 51 was an elastic roller, this portion was deformed by being continuously subjected to the pressure due to the abutment with the developing blade 53 while the developing apparatus was left as it was.

The developing roller set image failure, that is, the appearance of the sharp line of high density, occurred at the rotation period of the developing roller 51 because a uniform toner coat layer could not be formed in the deformed portion of the developing roller 51, and more specifically, because there was a difference in toner coat amount on the developing roller 51 between the deformed portion and the other portions.

Thus, first, the inventors directed their attentions to the surface roughness of the developing blade 23 for the purpose of making the toner coat amount on the developing roller 21 uniform between the deformed portion and the other portions in the developing apparatus 2 described with reference to FIG. 2.

The developing blade 23 of the developing apparatus 2 was replaced with developing blades A to F, the construction of the developing apparatus 2 is made the same as that of the developing apparatus except the developing blade 23, and the developing apparatus 2 was left for one month in the environment of normal temperature and normal humidity (25° C., 60% RH). Table 1 shows results of performing the printout test using the developing apparatus 2 attached with the respective developing blades A to F.

TABLE 1

Surface Roughness of Developing Blade and Developing Roller Set Image Failure

| Blade | Ra | Rz | Rmax | Set Image Failure | Vertical Streaks |
|---|---|---|---|---|---|
| A | 0.08 | 0.20 | 0.80 | Occurred | Did not occur |
| B | 0.16 | 1.14 | 2.03 | Occurred | Did not occur |
| C | 0.20 | 1.96 | 2.26 | Did not occur | Did not occur |
| D | 0.59 | 3.20 | 3.93 | Did not occur | Did not occur |
| E | 0.86 | 4.00 | 5.03 | Did not occur | Did not occur |
| F | 1.03 | 4.99 | 11.45 | Did not occur | Occurred |

As it is evident from the above table, occurrence of the developing roller set image failure can be suppressed by setting the surface roughness of the developing blade 23 as Rz>2.0 μm, and preferably Ra>0.2 μm.

This is because, as a frictional force increases by making the surface of the developing blade 23 rough, that is, as an increase in the developer regulating force, which is the main purpose of providing the developing blade 23, occurs, the difference in toner coat amount on the developing roller 21 is eliminated between the deformed portion and the other portion of the developing roller 21 while the developing apparatus 2 is left as it is, and formation of a uniform toner coat layer becomes possible.

In addition, it was found that, in the case in which Rmax of the developing blade 23 was larger than the weight average particle diameter of approximately 7 μm in this embodiment, that is, unevenness of the developing blade 23 became larger than the toner particle diameter, a uniform toner coat could not be formed on the developing roller 21, which resulted in a vertical streak image.

As described above, the surface roughness of the developing blade 23 was set as Rz>2.0 μm, and preferably Ra>0.2 μm, and Rmax<weight average particle diameter of toner, whereby occurrence of developing roller set image failure and generation of a vertical streak image could be suppressed and, even after the developing apparatus 2 was left as it was for a long period of time, a uniform toner coat layer could be formed on the developing roller 21.

EXPERIMENTAL EXAMPLE 2

Moreover, the inventors directed their attentions to the surface roughness of the developing roller 21 for the purpose of forming a stable and uniform toner coat layer on the developing roller 21.

In this embodiment, a toner coat amount on the developing roller 21 necessary for obtaining a proper image concentration is 0.3 to 0.8 mg/cm$^2$.

Table 3 shows results of a printout test which was performed according to the method of Experimental Example 1 using developing blades C to E, which were able to suppress occurrence of developing roller set image failure and occurrence of vertical streaks, as the developing blade 23 and using developing rollers a to d shown in Table 2 below as the developing roller 21 in the developing apparatus 2. In Table 3, results on occurrence of developing roller set image failure are shown on the left side and results on generation of a vertical streak image are shown on the right side.

TABLE 2

| Surface Roughness of Developing Blade | | | |
|---|---|---|---|
| Kind of Developing Roller | Ra | Rz | Rmax |
| a | 0.61 | 3.86 | 3.86 |
| b | 0.89 | 5.00 | 7.28 |
| c | 1.43 | 6.37 | 7.48 |
| d | 1.96 | 10.48 | 13.34 |

TABLE 3

| Results on Developing Blades C to E and Developing Rollers a to d Toner coat amount/Vertical streaks | | | | |
|---|---|---|---|---|
| | | Developing Blade | | |
| | | C | D | E |
| Developing Roller | a | Little/ Did not occur | Little/ Did not occur | Little/ Did not occur |
| | b | Proper/ Did not occur | Proper/ Did not occur | Proper/ Did not occur |
| | c | Proper/ Did not occur | Proper/ Did not occur | Proper/ Did not occur |
| | d | Proper/ Occurred | Proper/ Occurred | Proper/ Occurred |

As it is evident from the above table, a toner coat amount on the developing roller 21 can be made proper and a satisfactory image concentration can be obtained by setting the surface roughness of the developing roller 21 as Rz>5.0 μm, and preferably Ra>0.9 μm.

In this embodiment, a toner coat amount necessary for achieving a satisfactory image concentration is 0.3 to 0.8 mg/cm$^2$. In this case, a toner coat equivalent to approximately two layers of toner is formed on the developing roller 21.

Thus, it was found that, in the case in which Rmax of the developing roller 21 is about twice as large as the weight average particle diameter of toner of approximately 7 μm and is larger than 13 μm, that is, in the case in which unevenness of the developing roller 21 become larger than a toner coat layer thickness necessary for achieving a proper image concentration, a uniform toner coat could not be formed on the developing roller 21, which resulted in a vertical streak image.

As described above, the surface roughness of the developing roller 21 was set as Rz>5.0 μm, and preferably Ra>0.9 μm, and Rmax<weight average particle diameter of toner×2, whereby a toner coat amount on the developing roller 21 could be made proper, that is, a satisfactory image concentration could be obtained, and generation of a vertical streak image could be suppressed.

As described above, in the case in which a printout test for 10,000 sheets was performed using the developing blade 23 and the developing roller 21 with the surface roughnesses Rz, Ra, and Rmax adjusted to the numerical values described above, a high quality image with a constant thin toner layer amount on the developing roller 21 and a stable image concentration could be obtained without occurrence of developing roller set image failure and without generation of a vertical streak image.

Note that, in order to prevent developing roller set image failure, it is preferable that the ten point average surface roughness Rz of the developing blade 23 is 0.3 times or more as large as the ten point average surface roughness Rz of the developing roller 21. In addition, in order to make the toner coat amount on the developing roller 21 proper, the ten point average surface roughness Rz of the developing blade 23 is preferably 0.8 times or less as large as the ten point average surface roughness Rz of the developing roller 21. Thus, it is advisable to set the ten point average surface roughness Rz of the developing blade 23 to be 0.3 to 0.8 times as large as the ten point average surface roughness Rz of the developing roller 21.

Note that, here, the surface roughnesses Rz, Ra, and Rmax are the ten point average surface roughness Rz, the center line average surface roughness Ra, and the maximum height Rmax according to Japanese Industrial Standard (JIS) B 0601. The surface roughnesses Rz, Ra, and Rmax were measured with respect to the surfaces of the developing blade 23 and the developing roller 21 using a contact surface roughness measuring instrument (Surfcoder SE-3400 manufactured by Kosaka Laboratory Ltd.). As the measuring conditions, the feed speed was 0.05 mm/sec., and the measuring length was 0.8 mm for the developing blade 23 and 2.5 mm for the developing roller 21.

Second Embodiment

A second embodiment in accordance with the present invention will be hereinafter described with reference to FIGS. 3A and 3B. Since the structures and actions of the components other than the developing blade 23 are identical with those of the first embodiment, descriptions of the components will be omitted.

In this embodiment, an elastic developing blade 23 is used, which is made of polyamide elastomer containing a polyamide component having high triboelectrification capability with respect to a toner of negative polarity and a polyether component having elasticity.

Figure 3A:
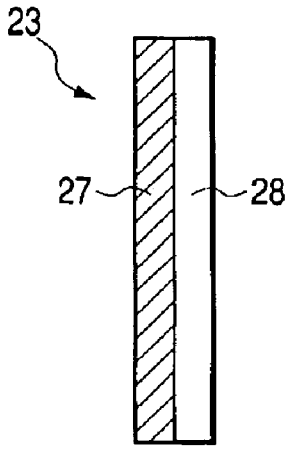
FIG. 3A is a sectional view showing an example of a developer regulating member in accordance with the present invention.
Figure 3B:
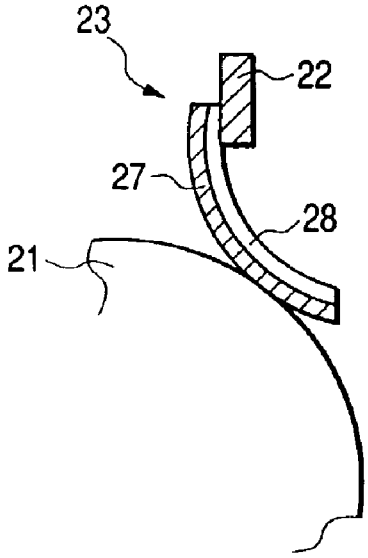
FIG. 3B is a sectional view showing a state in which the developer regulating member in accordance with the present invention is in contact with a developing roller.

As shown in FIG. 3B, the developing blade 23 is a blade of a thin plate shape as shown in FIG. 3A in which polyamide-containing rubber (hereinafter referred to as polyamide elastomer) 27 is laminated and adhered, as an elastic body, to an entire abutment surface of a phosphor bronze metal thin plate 28 with the developing roller 21, that is, to the entire surface of the thin metal plate 28 from the tip thereof on the side supported by the support metal sheet 22 serving as a support member to the free end side which is in surface contact with the external peripheral surface of the developing roller 21. The developing blade 23 is provided with a supported part supported by the support metal sheet 22 and a contact part which is in contact with the developing roller 21. As shown in FIG. 3B, the free end of the developing blade 23 is spaced apart from the surface of the developing roller 21.

The thickness of the phosphor bronze thin metal plate 28 is set to be 120 μm and the thickness of the polyamide elastomer is set to 27 is 30 μm.

The polyamide elastomer 27 is formed by bonding polyamide and polyether through amino bond or ester bond.

The polyamide component is not specifically limited. However, a polyamide component, which contains co-polyamide obtained from 6-nylon, 6, 6-nylon, 6, 12-nylon, 11-nylon, 12-nylon, 12, 12-nylon, or polycondensation of those monomers, and is preferably obtained by carboxylating a terminal amino group of polyamide with dibasic acid or the like, is used. As the dibasic acid, saturated aliphatic dicarboxylic acid such as oxalic acid, succinic acid, adipic acid, suberic acid, sebatic acid, and dodecanic acid, unsaturated aliphatic dicarboxylic acid such as maleic acid, aromatic dicarboxylic acid such as phthalic acid and terephthalic acid, and polydicarboxylic acid containing the dibasic acid and diol such as ethylene glycol, butanediol, hexanediol, and octanediol, and the like are used. In addition, as the polyether component, polyether such as homopolymerized or copolymerized polyethylene glycol, polypropylene glycol, and polytetramethylene glycol, polyetherdiamine with both ends aminated, and the like are used.

The polyamide elastomer used in this embodiment uses 12-nylon as the polyamide component, is reacted with dodecanic acid as dibasic acid and reacted using polytetramethylene glycol as the polyether component, and after being dried for a predetermined time, is subjected to laminating treatment on the phosphor bronze metal thin plate.

In the case in which the conventional developing apparatus using a developing blade in which polyamide elastomer was subjected to laminating treatment on the phosphor bronze thin metal plate (developing apparatus in which a contact surface of a developing blade with respect to a developing roller is a flat surface) was left as it was for one month in an environment of normal temperature and normal humidity (25° C., 60% RH), and a printout test of the developing apparatus was performed, a sharp line of high density appeared in the formed image, that is, so-called developing roller set image failure occurred at a rotation period of the developing roller.

The cause of the developing roller set image failure is the same as that described in the first embodiment. The developing roller set image failure occurred because, since the developing roller 21 was an elastic roller, deformation occurred in a portion where the developing roller 21 and the developing blade 23 abutted with each other while the developing apparatus was left in the environment of normal temperature and normal humidity, so that a uniform toner coat layer could not be formed in this deformed portion of the developing roller 21. More specifically, the developing roller set image failure occurred because there was a difference in toner coat amount on the developing roller 21 between the deformed portion and the other portions.

Thus, the inventors also set the surface roughnesses as Rz>2.0 $\mu$m, and preferably Ra<0.2 $\mu$m, and Rmax<weight average particle diameter of toner for a developing apparatus using polyamide elastomer subjected to laminating treatment on the phosphor bronze thin metal plate, and performed a printout test of the developing apparatus. Then, occurrence of developing roller set image failure and occurrence of a vertical streak image could be suppressed and, even immediately after the developing apparatus was left as it was for a long period of time, a uniform toner coat layer could be formed on the developing roller 21.

Moreover, the elastic developing blade 23 was constituted by polyamide elastomer 27 containing the polyamide component having high triboelectrification capability with respect to a toner of negative polarity and a polyether component having elasticity, whereby fog due to insufficient triboelectrification capability with respect to a toner did not occur, and a satisfactory image could be obtained.

From the above results, also in the case in which the developing blade 23 with polyamide elastomer 27 adhered to and integrally molded over the entire surface of the thin metal plate 28 was used, occurrence of developing roller set image failure and generation of a vertical streak image could be suppressed and, even immediately after the developing apparatus was left as it was for a long period of time, a stable and uniform toner coat layer could be formed on the developing roller 21 so that a satisfactory image could be obtained.

Third Embodiment

Figure 4:
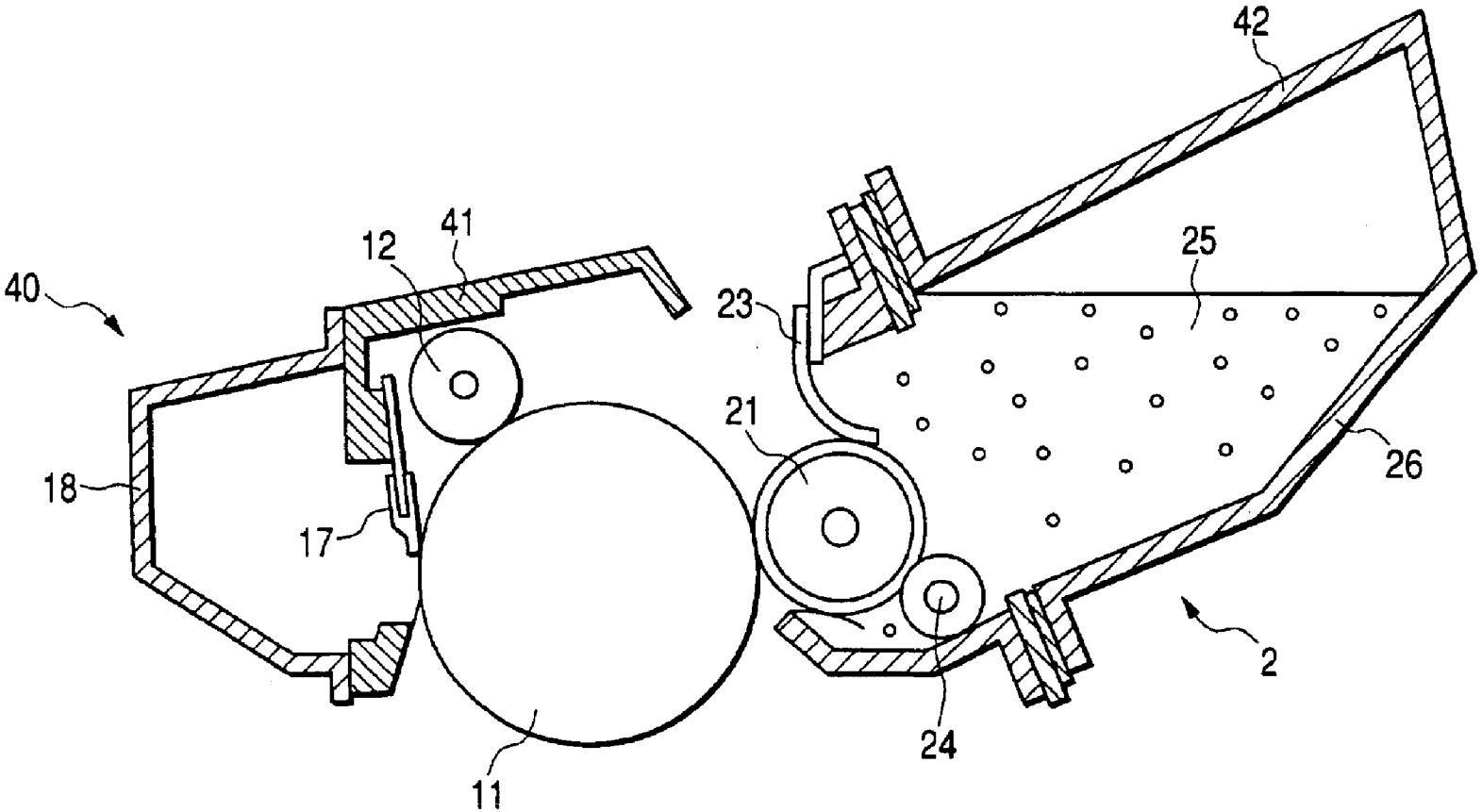
FIG. 4 is a schematic diagram showing an example of a process cartridge in accordance with the present invention.

FIG. 4 is a schematic sectional view showing an example of a process cartridge 40 to which the present invention is applied.

The process cartridge 40 is constituted by: a developing roller 21 serving as a developer carrying member; a developing apparatus 2 constituted by a developer regulating member 23 which is provided so as to abut against an external peripheral surface of the developing roller 21 in surface contact with the external peripheral surface, a supply roller 24, and the like; a photosensitive drum 11; charging means 12; and cleaning means 17. Those components are integrally constituted as a cartridge by plastic developing frame bodies 41 and 42.

That is, the process cartridge 40 of this embodiment is obtained by integrally constituting the developing apparatus 2 described in the first and second embodiments and a process component acting on the photosensitive drum 11 as a unit. Therefore, all the above-mentioned components of the developing apparatus 2 are applied in the process cartridge 40 in the same manner, and the process cartridge 40 is detachably attached to an image forming apparatus.

By adopting the above-mentioned structure, the effects described in the first to third embodiments can be obtained and, in addition, those components can be replaced easily. Therefore, ease of maintenance of the image forming apparatus is improved remarkably. In addition, important electrophotographic components are replaced with new components by replacing the cartridge, thereby allowing a high quality image to be always maintained.

In addition, the structure of the process cartridge is not limited to the above-mentioned structure. A process cartridge with a structure including either of the charging means 12 and the cleaning means 17, the photosensitive drum 11, and the developing apparatus 2, or a process cartridge integrally constituted by the developing apparatus 2 and the photosensitive drum 11 can also be applied.

As described above, in the present invention, the surface roughness of at least an abutment part of the developer regulating member 23 with a developer carrying member 21 was set such that the ten point average surface roughness Rz was larger than 2.0 $\mu$m and the maximum height Rmax was smaller than the average particle diameter of a developer 25. Thus, a uniform thin developer layer could be formed on the developer carrying member 21 and, even in the case in which the process cartridge 40 was left as it was for a long period of time, occurrence of developing roller set image failure could be prevented, and a high quality image could be maintained.

Moreover, for the developer carrying member 21, the surface roughness thereof was set such that the ten point average surface roughness Rz was larger than 5.0 $\mu$m and the maximum height Rmax was smaller than twice the average particle diameter of the developer 25, a stable thin developer film could be formed, and an apparatus capable of obtaining a high quality image with a stable image concentration could be provided.

What is claimed is:

1. A developer regulating member for regulating an amount of a developer carried on a developer carrying member, which carries the developer and has elasticity, comprising:

a supported part supported by a support member; and a contact part in contact with the developer carrying member, wherein the contact part has a ten point average surface roughness larger than 2.0 $\mu$m and a maximum height surface roughness smaller than an average particle diameter of the developer.

2. A developer regulating member according to claim 1, wherein the developer regulating member is plate-shaped and at least the contact part thereof includes an elastic body.

3. A developer regulating member according to claim 2, wherein the elastic body contains polyamide.

4. A developer regulating member according to claim 2, wherein the elastic body is a rubber layer containing polyamide.

5. A developer regulating member according to claim 4, wherein the rubber layer contains a polyamide component and a polyether component.

6. A developer regulating member according to claim 4, wherein the rubber layer is formed by bonding polyamide and polyether through one of an ester bond and an amide bond.

7. A developer regulating member according to claim 1, wherein the contact part has a center line average surface roughness larger than 0.2 $\mu$m.

8. A developer regulating member according to claim 1, wherein the contact part has a maximum height surface roughness smaller than 7 $\mu$m.

9. A developer regulating member according to claim 1, wherein the average particle diameter of the developer is a weight average particle diameter.

10. A developer regulating member according to claim 1, wherein the developer is a nonmagnetic one-component developer.

11. A developer regulating member according to claim 10, wherein the developer has shape factors SF-1 of 100 to 180 and SF-2 of 100 to 140.

12. A developer regulating member according to claim 1, wherein the support member is a sheet metal.

13. A developer regulating member according to claim 1, wherein the developer carrying member is roller-shaped.

14. A developer regulating member according to claim 1, wherein the developer carrying member has a ten point average surface roughness larger than 5.0 $\mu$m and a maximum height surface roughness smaller than twice the average particle diameter of the developer.

15. A developer regulating member according to claim 14, wherein the developer carrying member has a center line average surface roughness larger than 0.9 $\mu$m.

16. A developer regulating member according to claim 14, wherein the developer carrying member has a maximum height surface roughness larger than 13 $\mu$m.

17. A developer regulating member according to claim 1, wherein the contact part has a ten point average surface roughness 0.3 to 0.8 times a surface roughness of the developer carrying member.

18. A developer regulating member according to claim 1, wherein an ASKER-C hardness of the developer carrying member is 35° to 70°.

19. A developer regulating member according to claim 1, wherein a linear pressure of the developer regulating member against the developer carrying member is 15 to 50 g/cm.

20. A developer regulating member according to claim 1, wherein an amount of the developer on the developer carrying member is 0.3 to 0.8 mg/cm$^2$.

21. A developing apparatus comprising:

a developer carrying member, which carries a developer and has elasticity; and a developer regulating member, which regulates an amount of the developer carried on the developer carrying member, the developer regulating member comprising a supported part supported by a support member and a contact part, which is in contact with the developer carrying member, wherein the contact part has a ten point average surface roughness larger than 2.0 $\mu$m and a maximum height surface roughness smaller than an average particle diameter of the developer.

22. A developing apparatus according to claim 21, wherein the developer regulating member is plate-shaped and at least the contact part thereof includes an elastic body.

23. A developing apparatus according to claim 22, wherein the elastic body contains polyamide.

24. A developing apparatus according to claim 22, wherein the elastic body is a rubber layer containing polyamide.

25. A developing apparatus according to claim 24, wherein the rubber layer contains polyamide and polyether.

26. A developing apparatus according to claim 24, wherein the rubber layer is formed by bonding polyamide and polyether through one of an ester bond and an amide bond.

27. A developing apparatus according to claim 21, wherein the contact part has a center line average surface roughness larger than 0.2 $\mu$m.

28. A developing apparatus according to claim 21, wherein the contact part has a maximum height surface roughness smaller than 7 $\mu$m.

29. A developing apparatus according to claim 21, wherein the average particle diameter of the developer is a weight average particle diameter.

30. A developing apparatus according to claim 21, wherein the developer is a nonmagnetic one-component developer.

31. A developing apparatus according to claim 30, wherein the developer has shape factors SF-1 of 100 to 180 and SF-2 of 100 to 140.

32. A developing apparatus according to claim 21, wherein the support member is a sheet metal.

33. A developing apparatus according to claim 21, wherein the developer carrying member is roller-shaped.

34. A developing apparatus according to claim 21, wherein the developer carrying member has a ten point average surface roughness larger than 5.0 $\mu$m and a maximum height surface roughness smaller than twice the average particle diameter of the developer.

35. A developing apparatus according to claim 34, wherein the developer carrying member has a center line average surface roughness larger than 0.9 $\mu$m.

36. A developing apparatus according to claim 34, wherein the developer carrying member has a maximum height surface roughness larger than 13 $\mu$m.

37. A developing apparatus according to claim 21, wherein the contact part has a ten point average surface roughness 0.3 to 0.8 times a surface roughness of the developer carrying member.

38. A developing apparatus according to claim 21, wherein an ASKER-C hardness of the developer carrying member is 35° to 70°.

39. A developing apparatus according to claim 21, wherein a linear pressure of the developer regulating member against the developer carrying member is 15 to 50 g/cm.

40. A developing apparatus according to claim 21, wherein an amount of the developer on the developer carrying member is 0.3 to 0.8 $mg/cm^2$.

41. A developing apparatus according to claim 21, wherein the developing apparatus is provided in a process cartridge, which can be detachably attached to an image forming apparatus main body, together with an image bearing member.

* * * * *

UNITED STATES PATENT AND TRADEMARK OFFICE

CERTIFICATE OF CORRECTION

PATENT NO. : 6,909,869 B2
DATED : June 21, 2005
INVENTOR(S) : Shinya Yamamoto et al.

It is certified that error appears in the above-identified patent and that said Letters Patent is hereby corrected as shown below:

Title page,
Item [57], ABSTRACT,
Line 1, “apparatus” should read -- apparatus member --.

Figure 5:
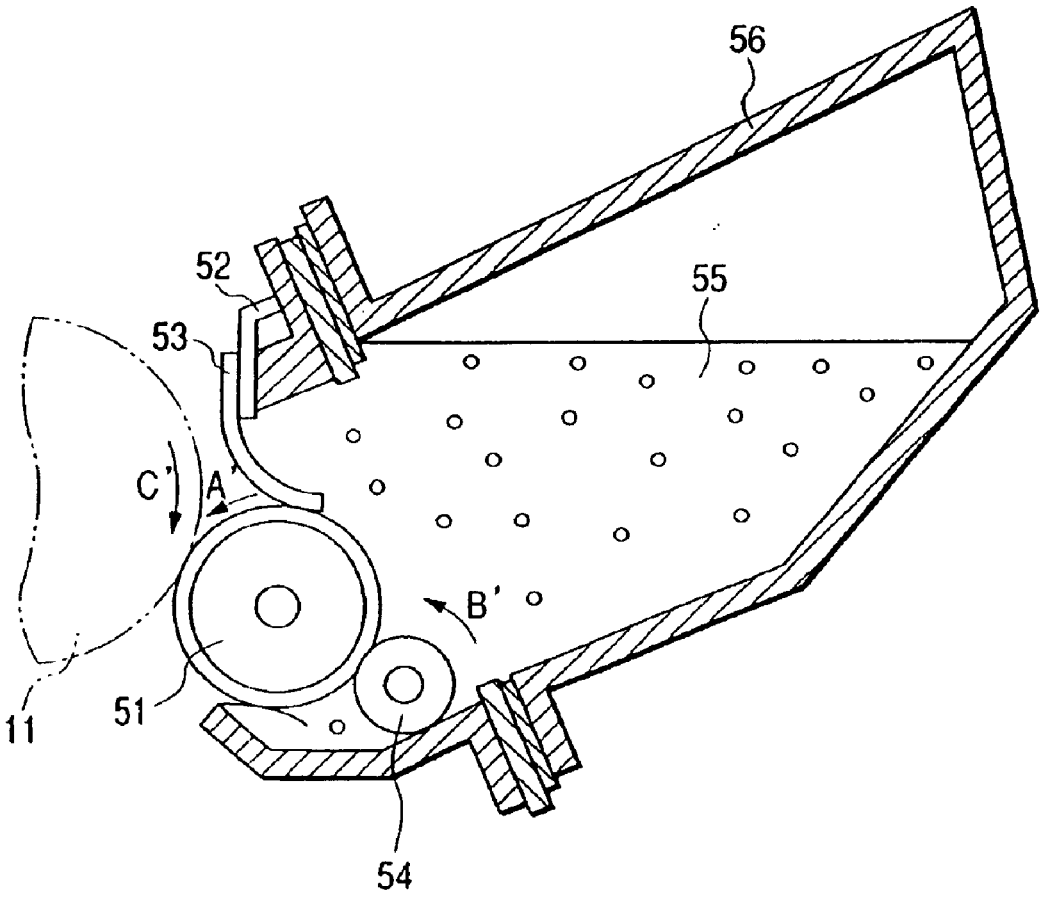
FIG. 5 PRIOR ART
FIG. 5 is a sectional view showing an example of a conventional developing apparatus.

Column 1,
Line 58, “Fig. The” should read -- Fig. 5. The --; and
Line 59, “5 includes” should read -- includes --.

Column 3,
Line 40, “be as” should read -- be --.

Column 7,
Line 23, “apparatus 5” should read -- apparatus --.

Column 10,
Line 41, “metal thin” should read -- thin metal --; and
Line 54, “27 is” should read -- 27 and is --.

Column 11,
Lines 41 and 47, “apparatus” should read -- apparatus 2a --; and
Line 44, “apparatus.” should read -- apparatus 2a. --.

Signed and Sealed this

Twenty-fifth Day of October, 2005

JON W. DUDAS
*Director of the United States Patent and Trademark Office*